US008556061B2

(12) United States Patent
Hu et al.

(10) Patent No.: US 8,556,061 B2
(45) **Date of Patent: *Oct. 15, 2013**

(54) COIN/BILL ACCEPTOR

(75) Inventors: Chia-Hung Hu, Taipei Hsien (TW); Chih-Sheng Cheng, Taipei (TW); Teng-Chou Hsiao, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 3 days.

This patent is subject to a terminal disclaimer.

(21) Appl. No.: 13/291,220

(22) Filed: Nov. 8, 2011

(65) Prior Publication Data

US 2013/0032447 A1 Feb. 7, 2013

(30) Foreign Application Priority Data

Aug. 2, 2011 (TW) ..... 100214261 A

(51) Int. Cl.
*G07F 1/00* (2006.01)
*G07F 7/04* (2006.01)

(52) U.S. Cl.
USPC ..... 194/206; 194/344

(58) Field of Classification Search
USPC ..... 194/206, 302, 344, 346, 350; 453/1, 18, 453/63; 361/724
See application file for complete search history.

(56) References Cited

U.S. PATENT DOCUMENTS 7,335,903 B1 * 2/2008 Yang et al. ..... 250/566
2004/0140175 A1 * 7/2004 Guindulain Vidondo .... 194/206

* cited by examiner

*Primary Examiner* — Mark Beauchaine
(74) *Attorney, Agent, or Firm* — Muncy, Geissler, Olds & Lowe, PLLC

(57) ABSTRACT

A coin/bill acceptor includes a face panel defining a bill insertion slot, a coin insertion slot and a coin return slot, a first housing fastened to the back side of the face panel and defining a bill passageway in communication with the bill insertion slot and accommodating therein a transmission unit for transferring the inserted bill from the bill insertion slot into the bill passageway and a bill validator module for sensing the authenticity and value of the inserted bill, a second housing hinged to the first housing at one lateral side, a spacer board being attached to the inner lateral side of the second housing and defining a coin passageway in communication with the coin insertion slot and a coin return passageway in communication with the coin return slot, a coin validator module being arranged in the for sensing the authenticity and value of the inserted.

12 Claims, 10 Drawing Sheets

COIN/BILL ACCEPTOR

This application claims the priority benefit of Taiwan patent application number 100214261 file on Aug. 2, 2011.

BACKGROUND OF THE INVENTION

1. Field of the Invention

The present invention relates to coin/bill acceptors and more particularly, to such a coin/bill acceptor, which utilizes a spacer board to divide a space in between a first housing and a second housing into a bill passageway and a coin passageway, minimizing the dimension of the coin/bill acceptor.

2. Description of the Related Art

Following fast development of social civilization and technology, people accelerate their pace of life and COAXIAL CABLE CONNECTOR ASSEMBLY demand a better quality of life. In consequence, various automatic vending machines are used everywhere to sell different products without serviceman, bringing convenience to people and helping suppliers save much labor cost. Following increment of selling items, new automatic vending machines with added functions are developed.

Further, regular automatic vending machines and game machines commonly use a coin acceptor for receiving coins so that a consumer can insert coins into an automatic vending machine or game machine to purchase commodities or to play games. However, as regular automatic vending machines and game machines simply accept coins, their application is limited. A people cannot use these machines without coins. Further, because a coin has a certain gravity weight, it is inconvenient to carry a number of coins in the pocket. Further, an amusement center may provide a coin exchange service. However, hiring an extra staff to offer this service costs a lot. Further, a non-serviceman shop does not offer a coin exchange service.

To eliminate the aforesaid problem, a vending machine or game machine may be equipped with a coin acceptor for receiving coins and a bill acceptor for receiving bills. However, using a coin acceptor and a bill acceptor in a machine greatly increases the cost and the dimension of the machine. Further, some machine designs do not provide much space for accommodating a coin acceptor and a bill acceptor together. To modify the specification of the machine for accommodating a coin acceptor and a bill acceptor may affect the performance of the machine.

Therefore, it is desirable to provide a measure that eliminates the aforesaid problems.

SUMMARY OF THE INVENTION

The present invention has been accomplished under the circumstances in view. It is therefore an object of the present invention to provide a coin/bill acceptor comprising a spacer board for separating a common channel into a bill passageway and a desired coin passageway, which accepts coins and bills and has a small size characteristic.

It is another object of the present invention to provide a coin/bill acceptor comprising a spacer board which enables the distance in which each inserted bill is to be transferred by the transmission unit to be greatly extended and facilitates smooth movement of each inserted coin into the coin passage without interfering with the bill path.

A further object of the present invention is to provide a coin/bill acceptor using same two circuit boards for mounting of a. bill validator module and the coin validator module and saving space.

Another object of the present invention is to provide a coin/bill acceptor comprising a plurality of bill-transfer rollers, a bill-transfer belt mounted on the bill-transfer rollers and a plurality of presser devices aimed at the bill-transfer rollers of the transmission unit for pressing on the inserted bill being transferred by the bill-transfer belt, enhancing bill transfer stability and avoiding slipping or bill jam and assuring a high level of accuracy in the recognition of the authenticity and value of each inserted bill.

Yet a further object of the invention is to provide a coin/bill acceptor comprising at least one damping plate for reducing the moving speed of the inserted coins and keeping the coins apart, avoiding interference or jam and assuring sensing reliability and accuracy of the coin sensor module.

To achieve this and other objects of the present invention, a coin/bill acceptor comprises a face panel defining a bill insertion slot, a coin insertion slot and a coin return slot, a first housing fastened to the back side of the face panel and defining a bill passageway in communication with the bill insertion slot and accommodating therein a transmission unit for transferring the inserted bill from the bill insertion slot into the bill passageway and a bill validator module for sensing the authenticity and value of the inserted bill, a second housing hinged to the first housing, a spacer board being attached to the inner lateral side of the second housing and defining a coin passageway in communication with the coin insertion slot and a coin return passageway in communication with the coin return slot and accommodating therein a coin validator module for sensing the authenticity and value of the inserted coin. By means of setting the spacer board in between the first housing and the second housing, a common channel between the first and second housings is divided into the desired bill passageway and the desired coin passageway, simplifying the structural arrangement and saving the cost.

Further, the arrangement of the spacer board enables the distance in which each inserted bill is to be transferred by the transmission unit to be greatly extended and facilitates smooth movement of each inserted coin into the coin passage without interfering with the bill path.

Further, the first housing houses therein a first circuit module providing a first circuit board; the second housing houses therein a second circuit module providing a second circuit board. The bill validator module comprises a bill recognition module, which comprises a plurality of light transmitters and light receivers respectively installed in the first circuit board and the second circuit board for sensing the inserted bill; the coin validator module comprises a coin sensor module, which comprises a plurality of induction coils for detecting the authenticity and value of the inserted coin. Hence, the bill validator module and the coin validator module use the same two circuit boards and reduce the space for installing additional circuit board.

Further, the transmission unit comprises a motor, a plurality of bill-transfer rollers rotatable by the motor, and a bill-transfer belt mounted on the bill-transfer rollers and rotatable by the bill-transfer rollers to transfer the inserted bill. Further, the second housing comprises a plurality of presser devices respectively disposed at top and bottom sides relative to the coin passageway and respectively aimed at the bill-transfer rollers of the transmission unit for pressing on the inserted bill being transferred by the bill-transfer belt, enhancing bill transfer stability.

Further, the second housing comprises at least one damping plate vertically mounted at an inside wall of the coin passageway between the second housing and the spacer board by one of the techniques of snap joint, screws and an adhesive.

By means of friction contact between the inserted coin and each damping plate, the moving speed of the inserted coin is slowed down. Thus, when multiple coins are inserted into the coin slot one after another, the inserted coins can be kept apart, avoiding interference or jam and assuring sensing reliability and accuracy of the coin sensor module.

DETAILED DESCRIPTION OF THE PREFERRED EMBODIMENT

Figure 1:
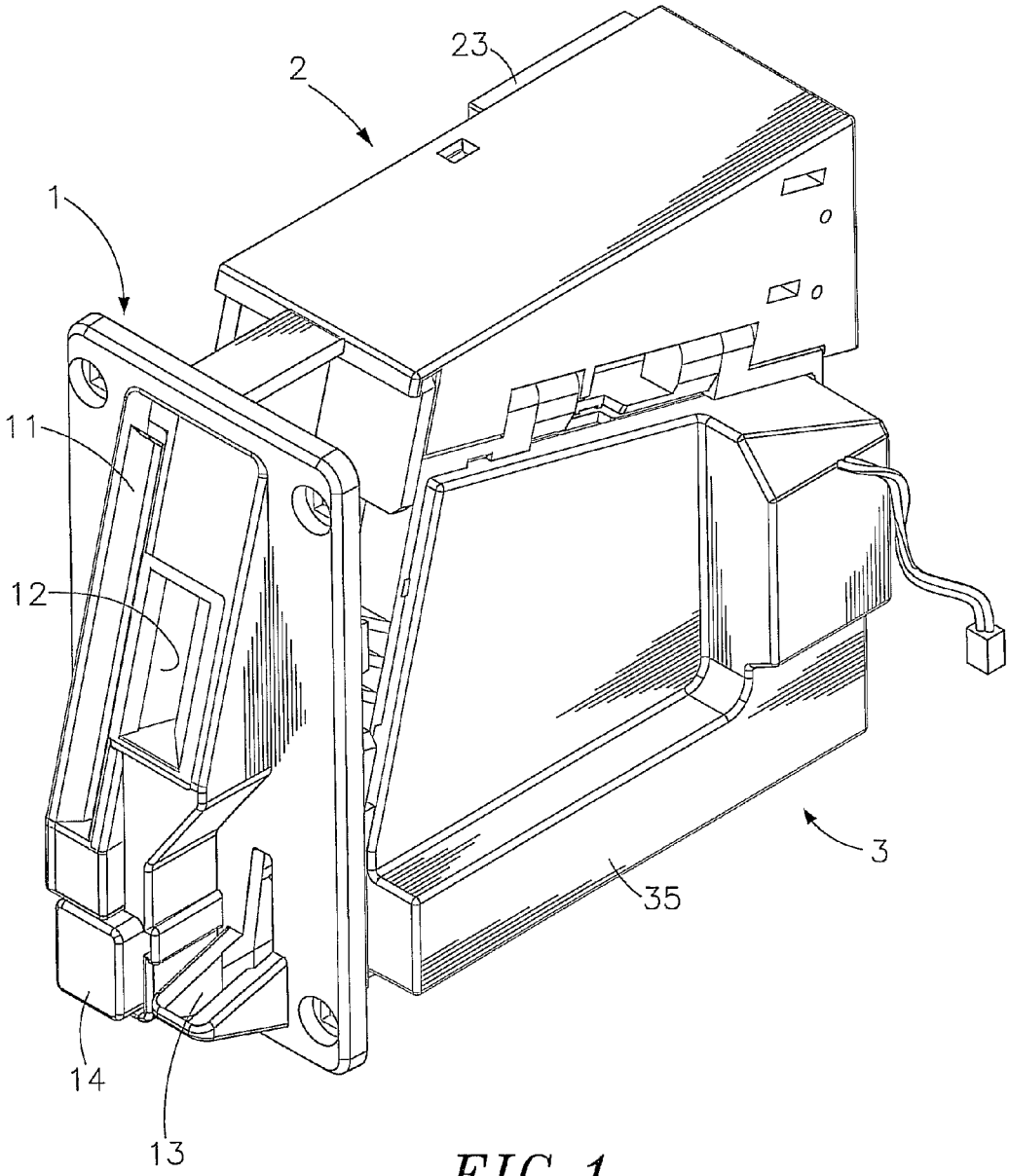
FIG. 1 is an elevational view of a coin/bill acceptor in accordance with the present invention.
Figure 2:
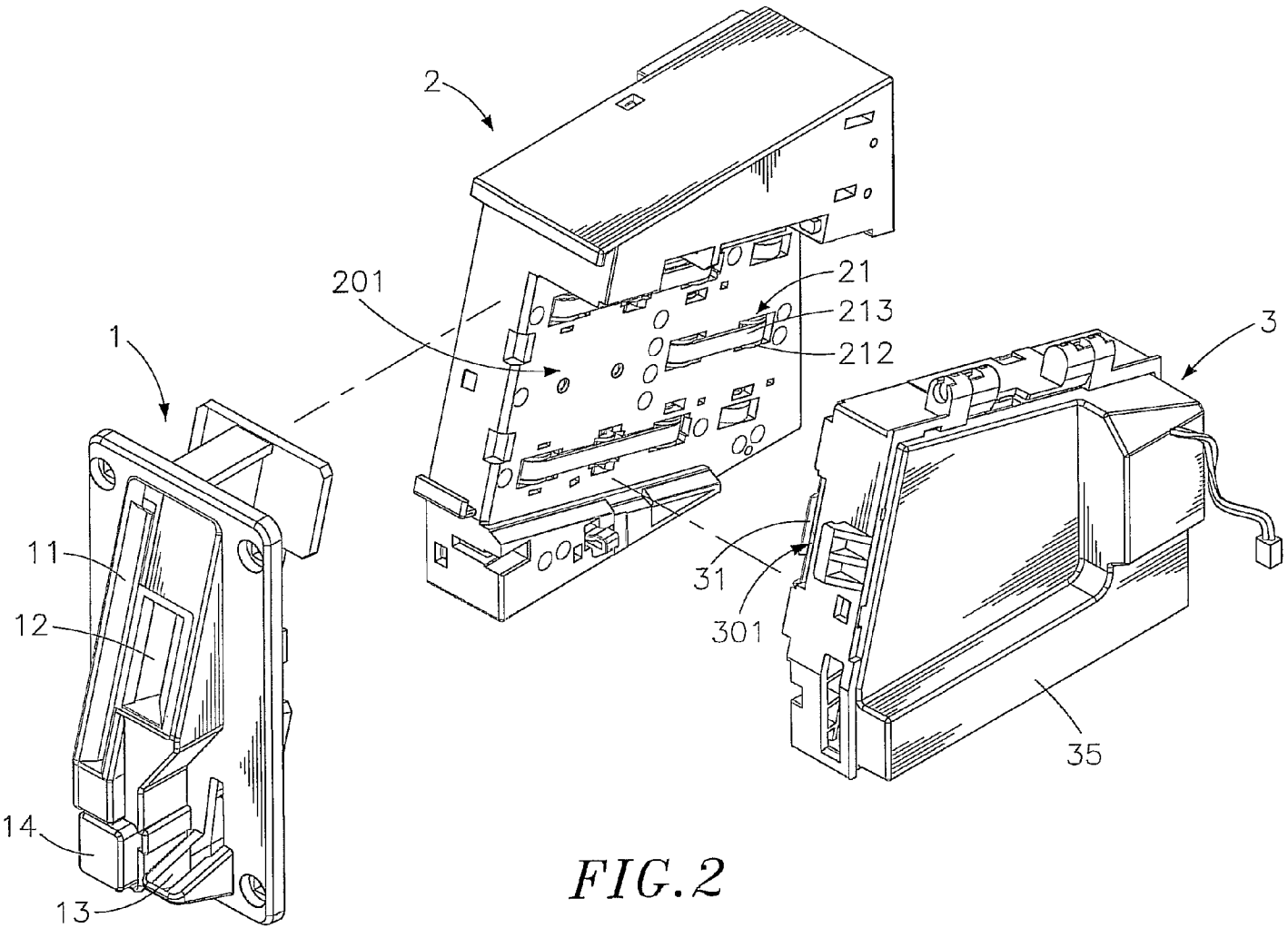
FIG. 2 is an exploded view of the coin/bill acceptor in accordance with the present invention.
Figure 3:
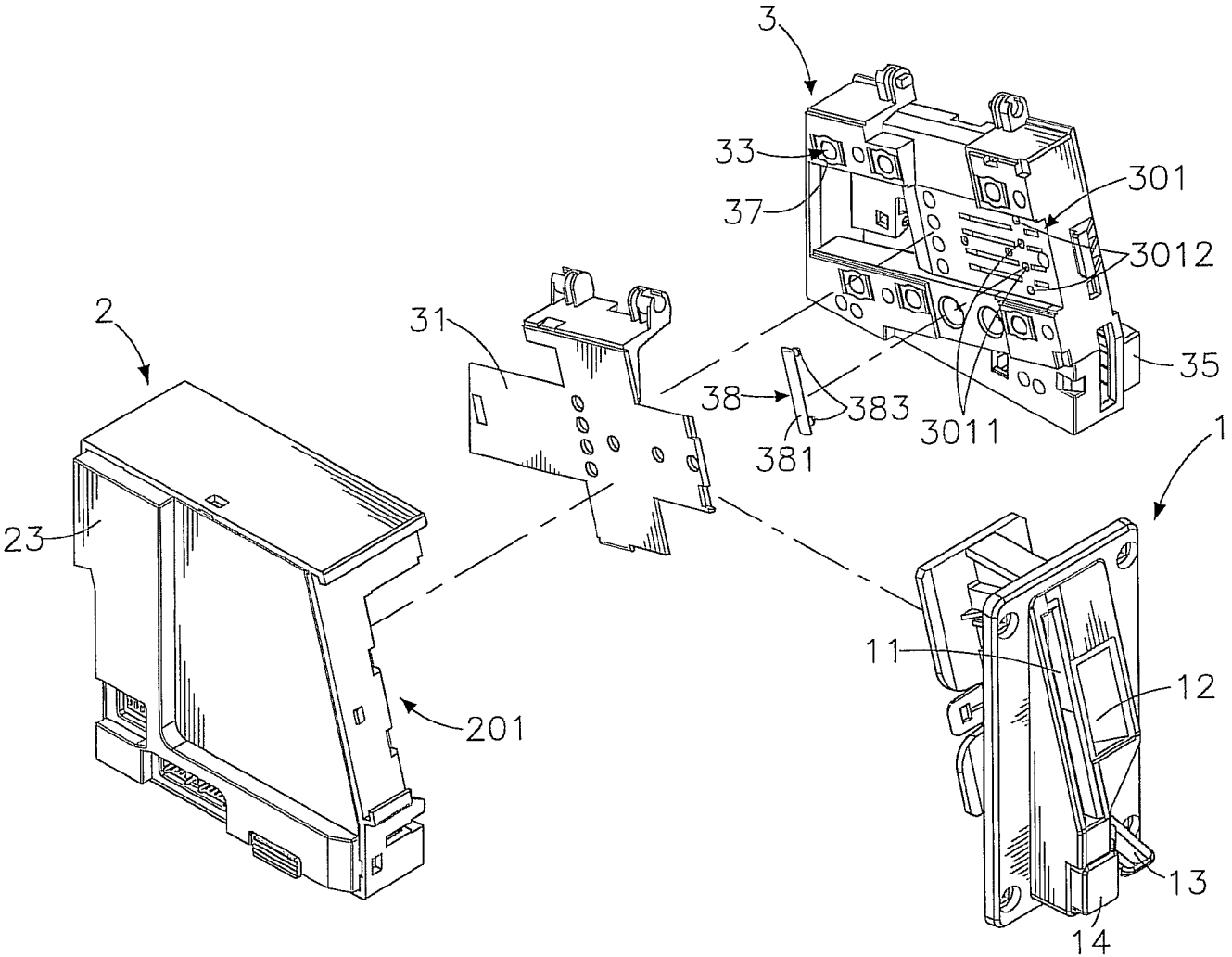
FIG. 3 corresponds to FIG. 2 when viewed from another angle.
Figure 4:
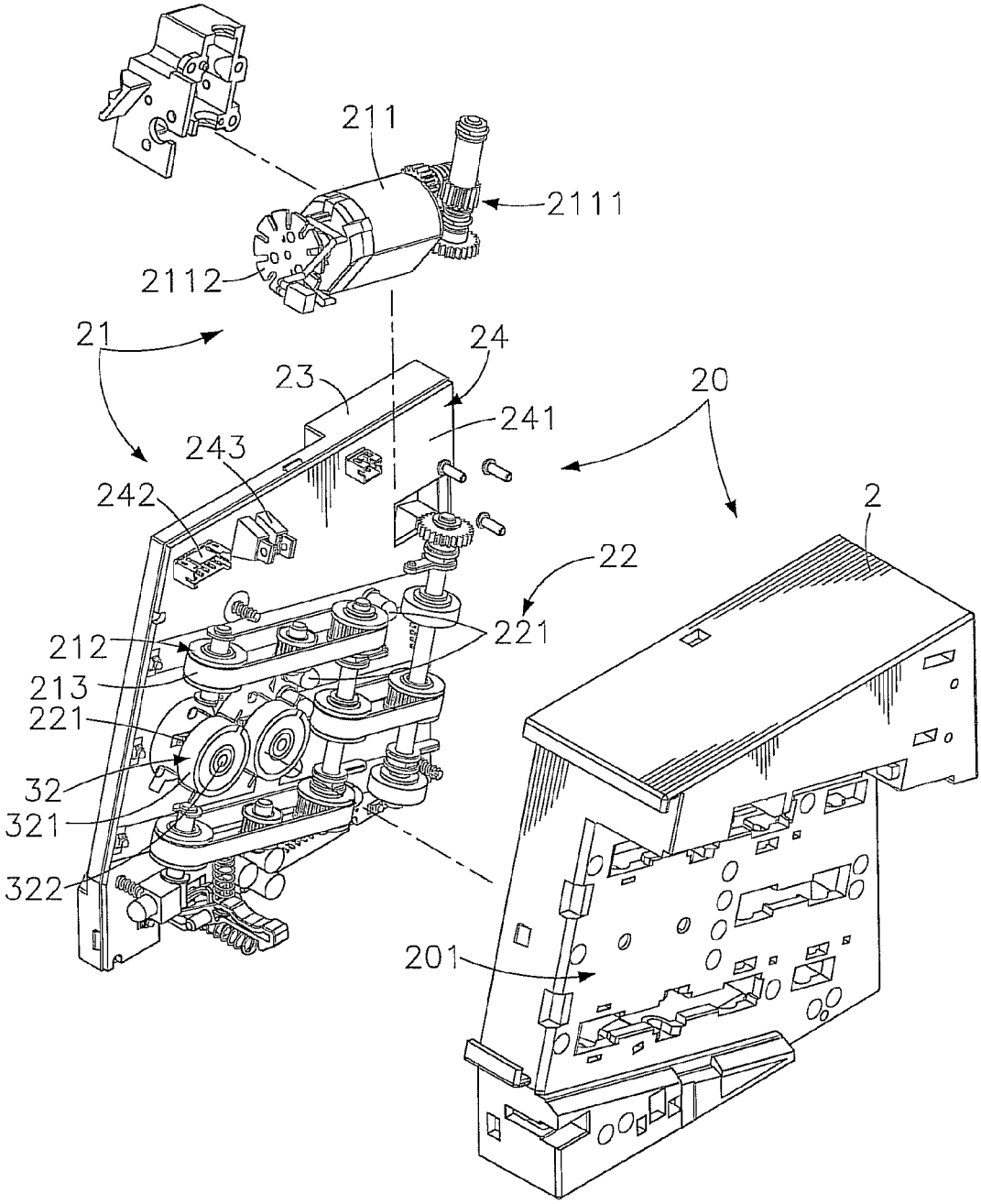
FIG. 4 is an exploded view of a first housing of the coin/bill acceptor in accordance with the present invention.
Figure 5:
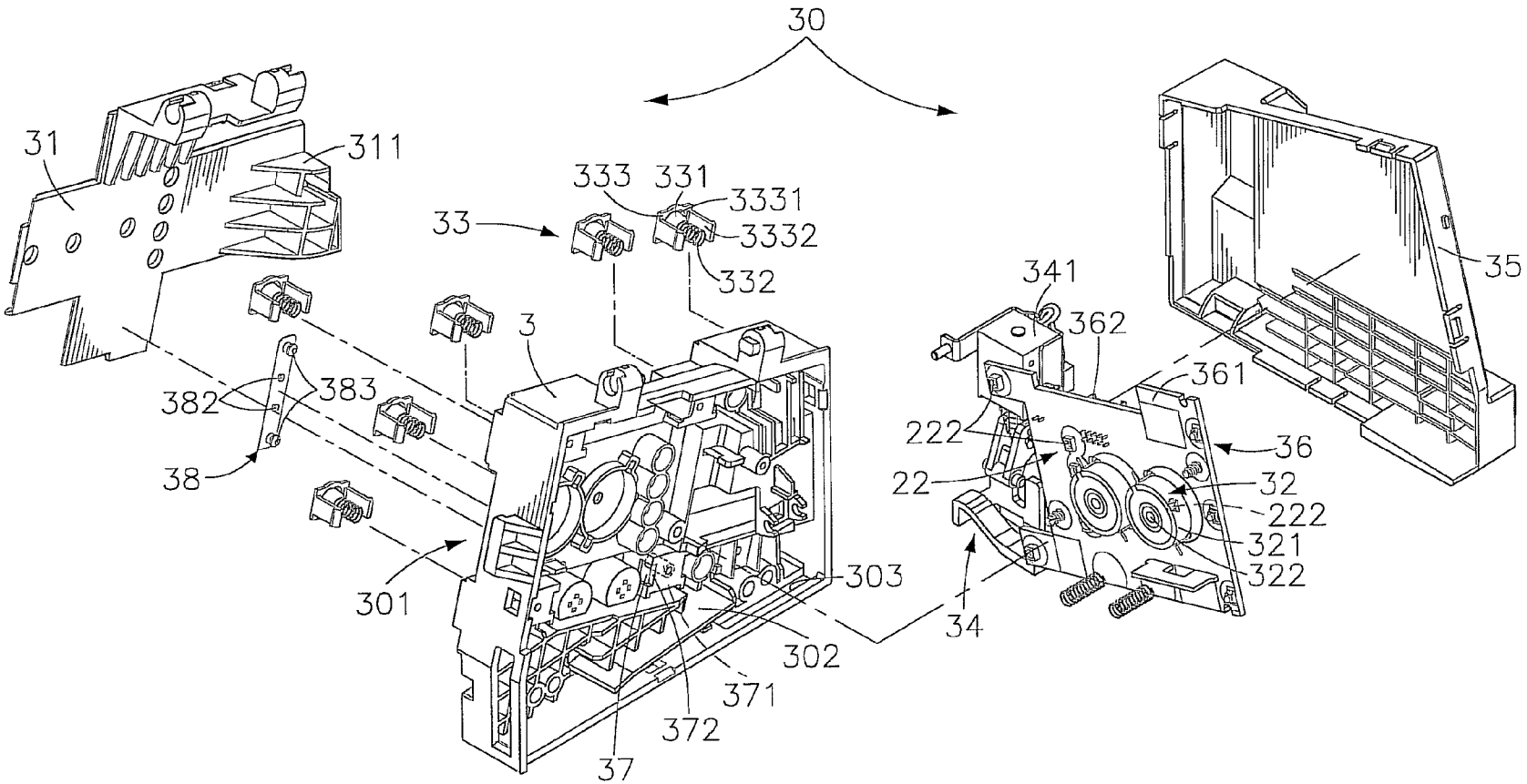
FIG. 5 is an exploded view of a second housing of the coin/bill acceptor in accordance with the present invention.

Referring to FIGS. 1-5, a coin/bill acceptor in accordance with the present invention is shown, comprising a face panel 1, a first housing 2, and a second housing 3.

The face panel 1 defines a bill insertion slot 11, a coin insertion slot 12 disposed adjacent to the bill insertion slot 11 at one lateral side, and a coin return slot 13 disposed at the bottom side of the coin insertion slot 12. Further, the face panel 1 is equipped with a coin return button 14 for pressing by the user to return the inserted coin.

The first housing 2 defines therein a bill passageway 201, and accommodates a bill validator module 20. The bill validator module 20 comprises a transmission unit 21 for transferring bills, a bill recognition module 22 for checking the authenticity and value of bills, a cover panel 23 covered on one lateral side of the first housing 2 and a circuit module 24 arranged in between the cover panel 23 and the first housing 2. The circuit module 24 comprises a circuit board 241. The transmission unit 21 comprises a motor 211, bill-transfer rollers 212 rotatable by the motor 211, and a bill-transfer belt 213 mounted on the bill-transfer rollers 212 and rotatable by the bill-transfer rollers 212 to transfer bills.

The second housing 3 is attached to an opposite lateral side of the first housing 2, which covers over the bill passageway 201. Further, the second housing 3 accommodates a coin validator module 30. A spacer board 31 is attached to the inner lateral side of the second housing 3 and defines a coin passageway 301 between the spacer board 31 and the second housing 3. A coin sensor module 32 faces toward the coin passageway 301 and is adapted for sensing the authenticity and value of a coin 5 passing through the coin passageway 301. A plurality of presser devices 33 are respectively disposed at top and bottom sides relative to the coin passageway 301 and respectively aimed at the bill-transfer rollers 212 of the transmission unit 21 for pressing on a bill 4 being transferred by the bill-transfer belt 213. A coin return passageway 302 extends from a gate 34 which is disposed at a rear bottom side of the coin passageway 301 and movable by an electromagnetic valve 341 to close/open the gap between the coin passageway 301 and the coin return passageway 302. A side cover 35 is covered on the outer lateral side of the second housing 3, and a circuit module 36 comprising a circuit board 361 is mounted between the side cover 35 and the second housing 3.

Further, a plurality of recessed chambers 37 are defined in the second housing 3 and respectively disposed at the top and bottom sides of the coin passageway 301 for accommodating the presser devices 33. Each presser device 33 comprises a rolling member 331, an elastic member 332 and a holder shell 333. The rolling member 331 can be a Delin ball or rolling needle. In this embodiment, a Deli ball is used for the advantages of having high rigidity, high friction coefficient and high chemical resistance characteristics. Further, the rolling member 331 is accommodated in the holder shell 333 and forced by the elastic member 332 to partially project out of a through hole 3331 in the holder shell 333. The elastic member 332 is set between the rolling member 331 and the respective recessed chamber 37, having its one end fastened to a locating pin 371 at the bottom side of the respective recessed chamber 37 and its other end stopped against the rolling member 331. Further, the holder shell 333 has two hooked arms 3332 respectively hooked in respective retaining holes 372 at two opposite lateral sides of the bottom wall of the respective recessed chamber 37.

Further, at least one damping plate 38 is vertically mounted at the inside wall of the coin passageway 301 between the second housing 3 and the spacer board 31 by a snap joint, screws, an adhesive, or any of a variety of other fastening techniques. In this embodiment, a plurality of through holes 3011 and retaining holes 3012 are formed in the inside wall of the coin passageway 301. Each damping plate 38 comprises a smoothly arched contact face 381, a plurality of locating pins 382 respectively inserted into respective through holes 3011 in the inside wall of the coin passageway 301, and two retaining rods 383 respectively disposed at top and bottom sides relative to the locating pins 382 and respectively fastened to a respective retaining hole 3012 in the inside wall of the coin passageway 301.

During installation of the present invention, the first housing 2 and the second housing 3 is hinged together such that the first housing 2 and the second housing 3 can be closed together, or opened from each other for cleaning or maintenance. When the first housing 2 and the second housing 3 are closed together, the spacer board 31 separates the bill passageway 201 and the coin passageway 301. Thereafter, the face panel 1 is fastened to the front side of the first housing 2 and the front side of the second housing 3, keeping the bill insertion slot 11 of the face panel 1 in communication with the bill passageway 201 of the first housing 2, and also keeping the coin insertion slot 12 and coin return slot 13 of the face panel 1 respectively in communication with the coin passageway 301 and coin return, passageway 302 of the second housing 3. After the coin/bill acceptor is assembled, it is installed in a vending machine, game machine, amusement machine, or the coin/bill-operated machine of any consuming system, keeping the face panel 1 of the coin/bill acceptor on the outside of the machine.

Figure 6:
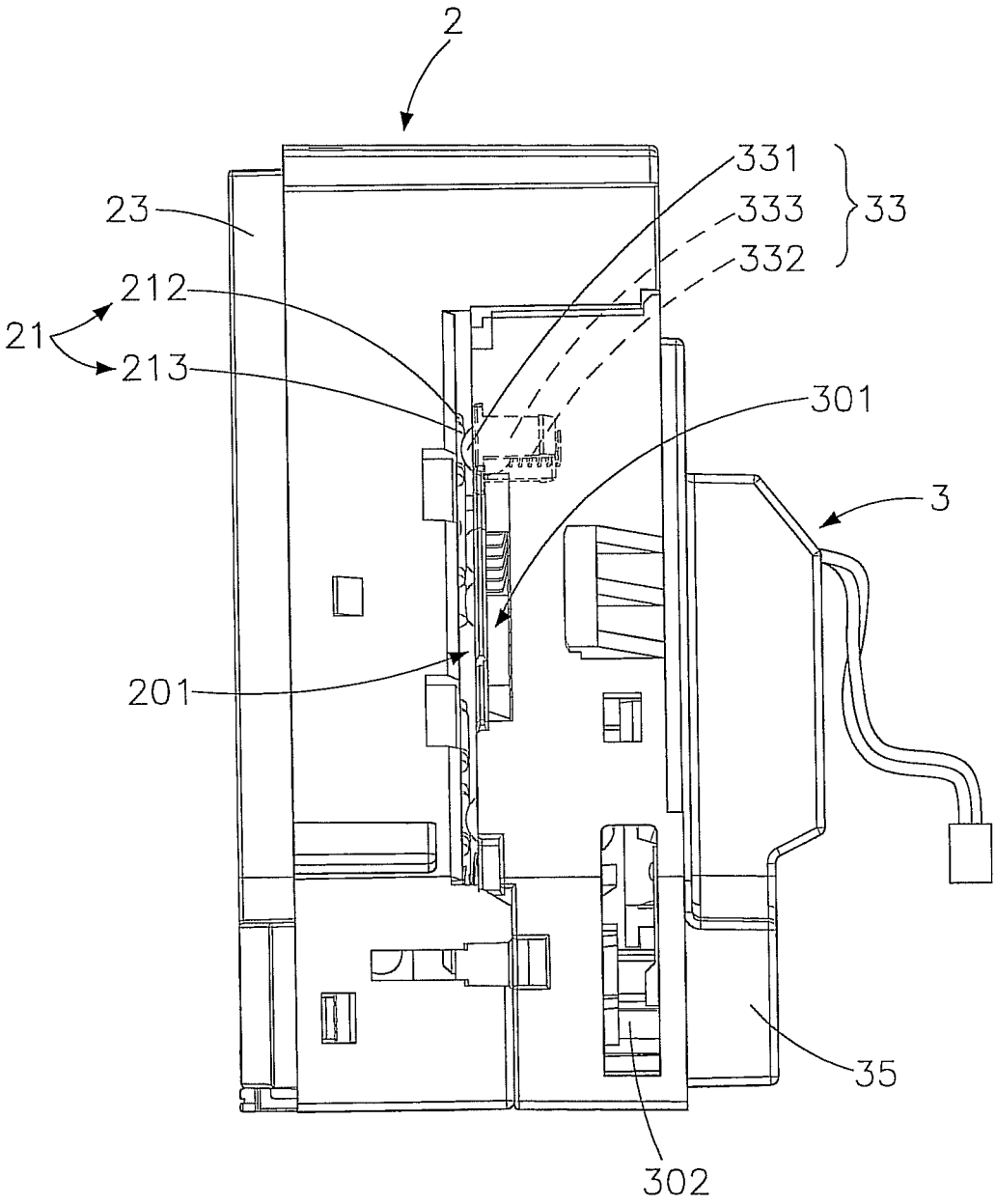
FIG. 6 is a front view of the coin/bill acceptor in accordance with the present invention.
Figure 7:
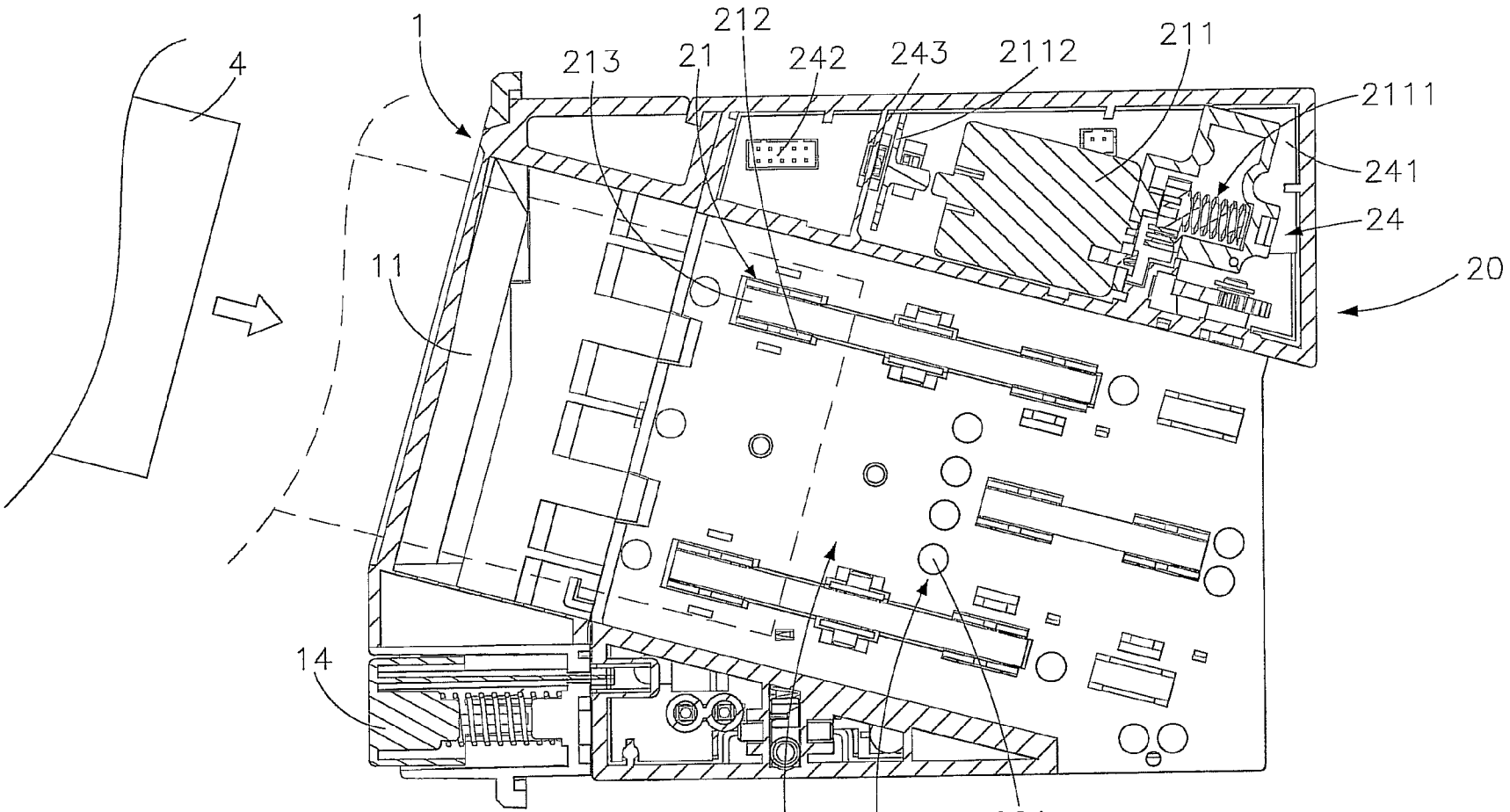
FIG. 7 is a sectional side view of the coin/bill acceptor in accordance with a first embodiment of the present invention.
Figure 8:
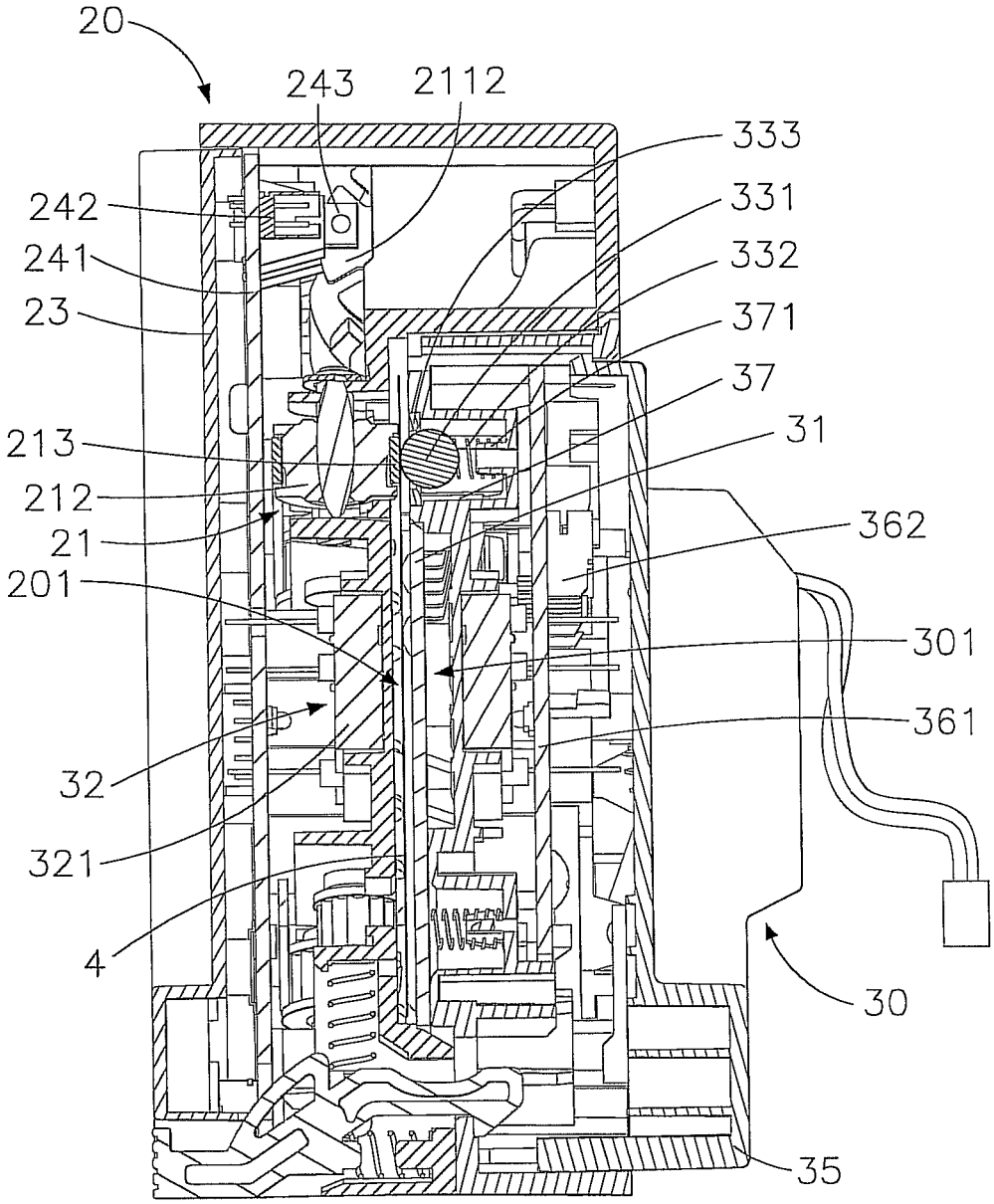
FIG. 8 is a sectional front view of the coin/bill acceptor in accordance with the first embodiment of the present invention.

Referring to FIGS. 6-8, after installation of the coin/bill acceptor in a machine (not shown), the electrical connector, referenced by 242, of the circuit board 241 of the circuit module 24 of the bill validator module 20 and the electrical connector, referenced by 362, of the circuit board 361 of the circuit module 36 of the coin validator module 30 are respectively electrically connected to the processor (not shown) of the machine. Thus, the machine can accept bills and coins. It is to be noted that the techniques how the control circuits of the circuit boards 241 and 361 of the circuit modules 24 and 36 work with the bill recognition module 22 to control the transmission unit 21 for transferring bills and the coin sensor module 32 to move the gate 34 for receiving or returning coins are of the known art. Further, many different coin return designs using a linkage, electromagnetic valve or step motor to move the gate 34 for coin return control may be selectively used. The present preferred embodiment simply explains one of the known techniques.

During application, a bill 4 or a coin 5 may be inserted into the bill insertion slot 11 or coin insertion slot 12 of the face panel 1. When a bill 4 is inserted into the bill insertion slot 11 of the face panel 1, the transmission unit 21 is initiated, causing the motor 211 to rotate the bill-transfer rollers 212 and the bill-transfer belt 213. At this time, the bill-transfer belt 213 is pressed on the leading edge of the inserted bill 4 against the rolling members 331 of the presser devices 33 to compress the respective elastic members 332, and continuously rotated to transfer the bill 4 into the bill passageway 201. Subject to the functioning of the elastic members 332 to match with the structural design of the transmission unit 21, the invention is suitable for transferring different bills having different thickness and can smoothly and positively transfer every inserted bill to the accurate position for recognition, avoiding slipping or bill jam and assuring a high level of accuracy in the recognition of the authenticity and value of each inserted bill.

When the inserted bill reached the predetermined recognition position, multiple light transmitters 221 and light receivers 222 of the bill recognition module 22 that are respectively installed in the circuit board 241 in the first housing 2 and the circuit board 361 in the second housing 3 are controlled to emit light onto predetermined areas of the bill 4 or to pick up the light that goes through the bill 4 for recognizing the authenticity and value of the bill 4. If the bill 4 is recognized to be a counterfeit, the transmission unit 21 is reversed to transfer the bill 4 back to the bill insertion slot 11. On the contrary, if the bill 4 is recognized to be a real bill, the transmission unit 21 will be controlled to transfer the bill 4 forwardly towards the rear end of the bill passageway 201. Further, an anti-theft hook (not shown) may be set in the bill passageway 201 to prevent cheating and to prevent an evil person from pulling back an examined bill 4 by means of a tool (such as iron wire, adhesive tape, and etc.). When a bill 4 passed through the rear end of the bill passageway 201, it will be carried out of the coin/bill acceptor into the inside of the machine (vending machine, game machine, amusement machine, or the coin/bill-operated machine of any consuming system that provides web services) and then pressed onto a bill-bearing board in a bill box by a bill-pressing mechanism (not shown).

The aforesaid transmission unit 21 further comprises a transmission member 2111 coupled to the motor 211 to drive the bill-transfer rollers 212 to rotate, and an optical grid wheel 2112 coupled to the transmission member 2111 and rotatable by the motor 211. The aforesaid bill validator module 20 further comprises a photo sensor 243 installed in the circuit board 241 of the circuit module 24 for sensing intermittent light passing through the optical grid wheel 2112 and generating a corresponding pulse signal, which is then transmitted to a control circuit (not shown) for computing the distance of displacement of the bill 4 being transferred by the transmission unit 21.

Figure 9:
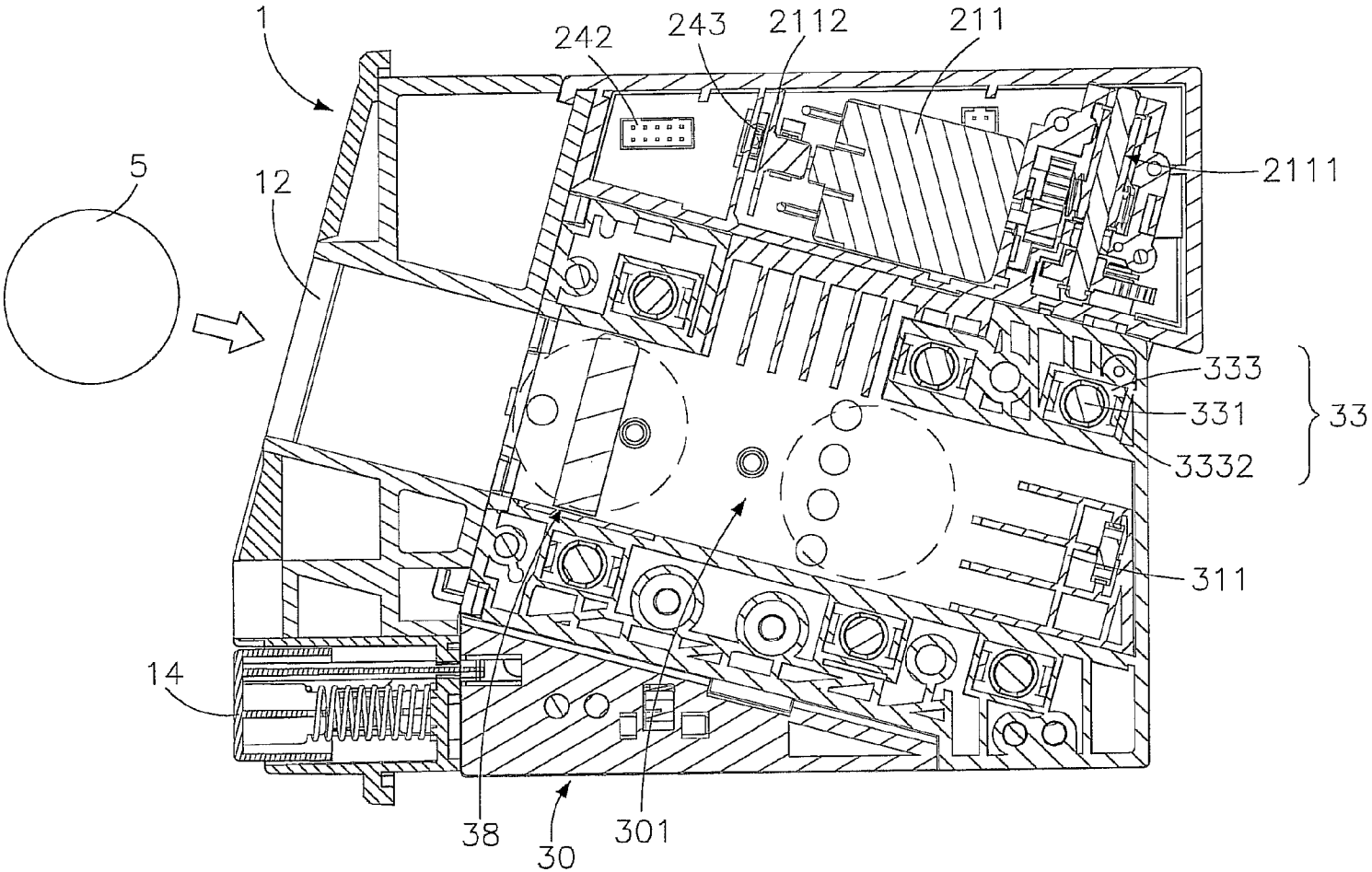
FIG. 9 is sectional side view of the coin/bill acceptor in accordance with a second embodiment of the present invention.
Figure 10:
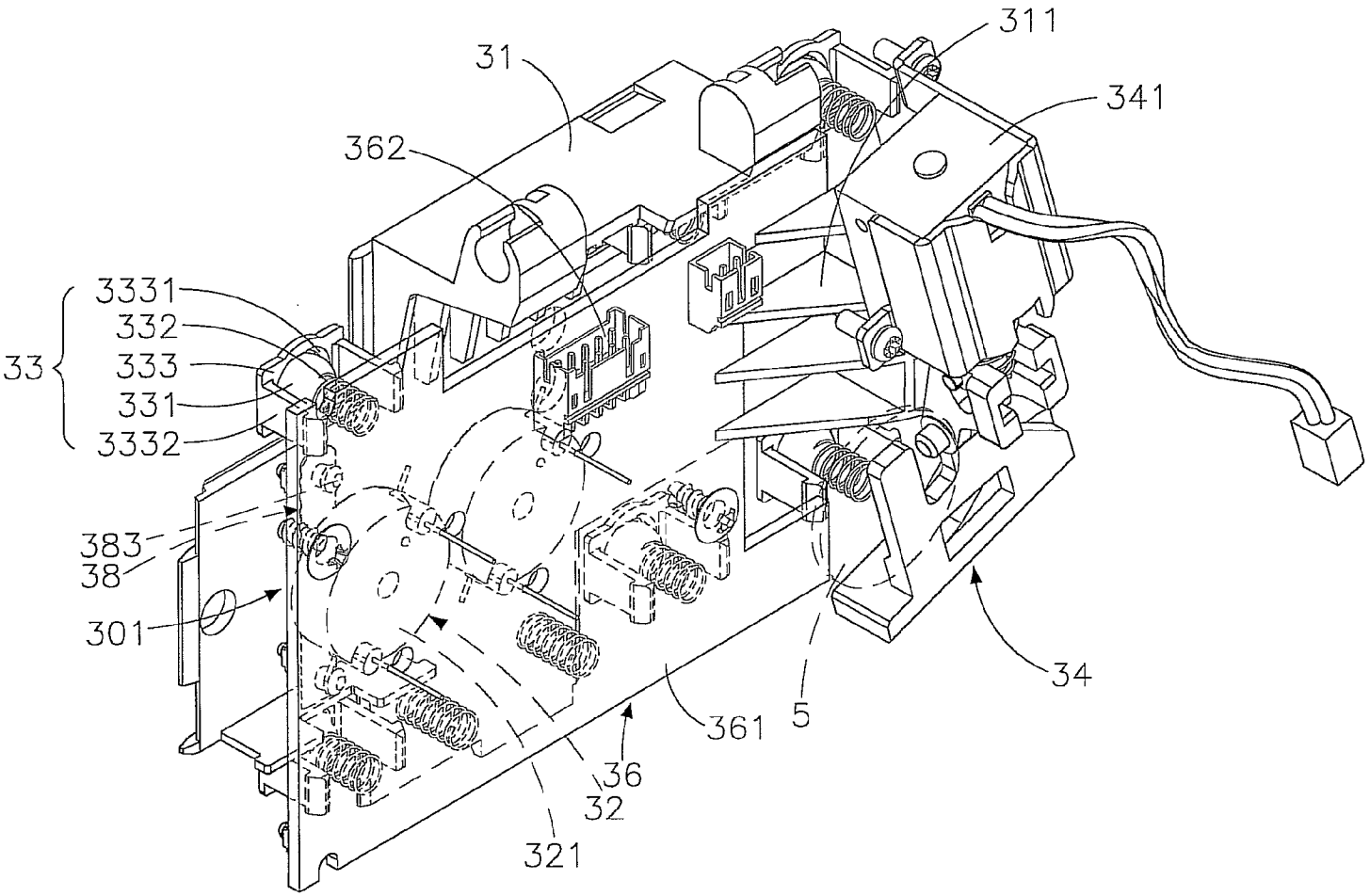
FIG. 10 is a perspective view of a part of FIG. 9.

Referring to FIGS. 9 and 10, when a coin is inserted into the coin insertion slot 12 of the face panel 1, it enters the coin passageway 301. At this time, the multiple iron cores and sensing coils 321 of the coin sensor module 32 that are respectively installed in the circuit board 241 in the first housing 2 and the circuit board 361 in the second housing 3 are controlled to detect the authenticity and value of the coin 5. If the coin 5 is recognized to be a real coin, the coin 5 is allowed to keep rolling downwardly toward the rear end of the coin passageway 301, and the anti-theft hook in the coin passageway 301 is controlled to rotate to the top side relative to the coin 5 to prevent cheating. As the coin passageway 301 slopes downwardly from the coin insertion slot 12 toward the location of the coin sensor module 32, each inserted coin 5 will rotate automatically from the coin insertion slot 12 to the coin sensor module 32 for sensing. By means of sensing the inductance value, the authenticity and value of each inserted coin 5 is detected.

As the width of the coin passageway 301 between the at_least one damping plate 38 and the second housing 3 or the spacer board 31 is slightly greater than the thickness of the inserted coin 5, the inserted coin 5 can rotate along one side of the at least one damping plate 38 into the coin passageway 301. By means of friction contact between the inserted coin 5 and a contact surface 381 of each damping plate 38, the moving speed of the inserted coin 5 is slowed down. Thus, when multiple coins 5 are inserted into the coin slot 12 one after another, the inserted coins 5 can be kept apart, avoiding interference or jam and assuring sensing reliability and accuracy of the coin sensor module 32.

As stated above, the spacer board 31 is set between the first housing 2 and the second housing 3 to separate the bill passageway 201 and the coin passageway 301, i.e., the spacer board 31 divides a common channel into the bill passageway 201 and the coin passageway 301. This design enables the distance in which each inserted bill 4 is to be transferred by the transmission unit 21 to be greatly extended and facilitates smooth movement of each inserted coin 5 into the coin passageway 301 without interfering with the bill path. When an inserted coin 5 passes the coin sensor module 32, it is guided by a rear guide portion 311 of the spacer board 31 to change its rolling direction so that the coin 5 can fall to the gate 34. At this time, the coin 5, if it is checked to be a counterfeit, will move along the front side of the gate 34 to the coin return passageway 302 toward the coin return slot 13. On the contrary, if the coin 5 is recognized to be a real coin, the electromagnetic valve 341 will be started to move the gate 34 in opening a coin outlet 303, enabling the coin 5 to fall into the coin box in the machine.

Further, a through hole 322 is defined in each sensing coil 321 of the coin sensor module 32 corresponding to one respective light transmitter 221 or light receiver 222 of the bill recognition module 22. Thus, the bill recognition module 22 and the coin sensor module 32 share the two circuit boards 241 and 361, saving much installation space and minimizing the dimension of the coin/bill acceptor.

Referring to FIGS. 2, 4 and 5 again, as stated above, the first housing 2 and the second housing 3 are respectively fastened to the back side of the face panel 1; the bill validator module 20 and the coin validator module 30 are respectively accommodated in the first housing 2 and the second housing 3; the spacer board 31 divides the space in between the first housing 2 and the second housing 3 into the bill passageway 201 and the coin passageway 301. Thus, the coin/bill acceptor has the characteristic of small size and is practical for use in a vending machine, game machine, amusement machine, or the coin/bill-operated machine of any consuming system that provides web services without changing the internal arrangement of the machine, allowing the machine to receive coins as well as bills.

It is to be understood that the above-described embodiments of the invention are merely possible examples of implementations, merely set forth for a clear understanding of the principles of the invention, many modifications and enhancements may be made without departing from the spirit and scope of the invention. Accordingly, the invention is not to be limited except as by the appended claims.

What the invention claimed is:

1. A coin/bill acceptor, comprising:

a face panel defining a bill insertion slot, a coin insertion slot disposed at one lateral side relative to said bill insertion slot, and a coin return slot disposed at a bottom side relative to said coin insertion slot;

a first housing fastened to a back side of said face panel, said first housing defining a bill passageway in communication with said bill insertion slot and accommodating therein a transmission unit adapted for transferring the inserted bill from said bill insertion slot into said bill passageway and a bill validator module adapted for sensing the authenticity and value of the inserted bill;

a second housing hinged to said first housing at one lateral side of said bill passageway and fastened to said back side of said face panel, said second housing defining therein a coin return passageway in communication with said coin return slot and accommodating therein a coin validator module adapted for sensing the authenticity and value of the inserted coin; and a spacer board fastened to one lateral side of said second housing and attached to one lateral side of said bill passageway and defining with said second housing a coin passageway in communication between said coin insertion slot and said coin return passageway.

2. The coin/bill acceptor as claimed in claim 1, wherein said face panel comprises a coin return button for pressing by the user to return the inserted coin.

3. The coin/bill acceptor as claimed in claim 1, wherein the transmission unit comprises a motor, a plurality of bill-transfer rollers rotatable by said motor, and a bill-transfer belt mounted on said bill-transfer rollers and rotatable by said bill-transfer rollers to transfer the inserted bill; said second housing comprises a plurality of presser devices respectively disposed at top and bottom sides relative to said coin passageway and respectively aimed at said bill-transfer rollers of said transmission unit for pressing on the inserted bill being transferred by said bill-transfer belt.

4. The coin/bill acceptor as claimed in claim 3, wherein said second housing further comprises a plurality of recessed chambers respectively disposed at the top and bottom sides of said coin passageway for accommodating said presser devices respectively; each said presser device comprises a rolling member, an elastic member and a holder shell, said rolling member being accommodated in said holder shell and forced by said elastic member to partially project out of a through hole in said holder shell for pressing on the bill being transferred by said bill-transfer belt.

5. The coin/bill acceptor as claimed in claim 4, wherein each said recessed chamber comprises a locating pin located on a bottom side thereof and two retaining holes at two opposite sides relative to said locating pin; said elastic member is set between said rolling member and the respective recessed chamber, having one end thereof fastened to the locating pin in the respective recessed chamber and an opposite end thereof stopped against said rolling member; said holder shell comprises two hooked arms respectively hooked in the retaining holes in the respective recessed chamber.

6. The coin/bill acceptor as claimed in claim 1, wherein said first housing further comprises a cover panel covered on an outer lateral side thereof; said bill validator module comprises a circuit module arranged in between said cover panel and said first housing, said circuit module comprising a circuit board having a control circuit which is electrically connected to a processor in a machine using the coin/bill acceptor.

7. The coin/bill acceptor as claimed in claim 1, further comprising an electromagnetic valve, and a gate movable by said electromagnetic valve to close/open the passage between said coin passageway and said coin return passageway.

8. The coin/bill acceptor as claimed in claim 1, further comprising a gate, wherein said second housing further comprises a side cover covered on an outer lateral side thereof, said coin validator module comprising a circuit module having a circuit board and being mounted in between said side cover and said second housing, said circuit board having a control circuit which is electrically connected to a processor in a machine using the coin/bill acceptor for controlling the gate to move for receiving or returning coins.

9. The coin/bill acceptor as claimed in claim 1, wherein said first housing houses therein a first circuit module providing a first circuit board; said second housing houses therein a second circuit module providing a second circuit board; said bill validator module comprises a bill recognition module, said bill recognition module comprising a plurality of light transmitters and light receivers respectively installed in said first circuit board and said second circuit board for sensing the inserted bill; said coin validator module comprises a coin sensor module, said coin sensor module comprising a plurality of induction coils for detecting the authenticity and value of the inserted coin, each said induction coil defining therein a through hole for the passing of the light emitted by one said light transmitter.

10. The coin/bill acceptor as claimed in claim 1, wherein said second housing comprises at least one damping plate vertically mounted at an inside wall of said coin passageway between said second housing and said spacer board by one of the techniques of snap joint, screws and an adhesive.

11. The coin/bill acceptor as claimed in claim 10, wherein said second housing comprises a plurality of through holes and retaining holes formed in an inside wall of said coin passageway; each said damping plate comprises a smoothly arched contact face for the contact of the inserted coin, a plurality of locating pins respectively inserted into the respective through holes in the inside wall of said coin respective through holes, and two retaining rods respectively disposed at top and bottom sides relative to said locating pins and respectively fastened to said retaining holes.

12. The coin/bill acceptor as claimed in claim 10, wherein the width between each said damping plate and said second housing or said spacer board is greater than the thickness of an inserted coin.

* * * * *